US005749021A

United States Patent [19]

Mestha et al.

[11] Patent Number: 5,749,021

[45] Date of Patent: May 5, 1998

[54] DEVELOPED MASS PER UNIT AREA (DMA) CONTROLLER TO CORRECT FOR DEVELOPMENT ERRORS

[75] Inventors: Lingappa K. Mestha, Fairport, N.Y.; Prasad P. Padmanabhan, San Francisco, Calif.

[73] Assignee: Xerox Corporation, Stamford, Conn.

[21] Appl. No.: 760,616

[22] Filed: Dec. 4, 1996

[51] Int. Cl.[6] ..... G03G 15/00

[52] U.S. Cl. ..... 399/49; 399/46

[58] Field of Search ..... 399/46, 48, 49, 399/50, 51, 53, 55, 72, 15, 59

[56] References Cited

U.S. PATENT DOCUMENTS

| | | | |
|---|---|---|---|
| 4,341,461 | 7/1982 | Fontozzi | 399/49 |
| 4,456,370 | 6/1984 | Hayes, Jr. | 399/50 |
| 4,563,086 | 1/1986 | Knapp et al. | 399/49 |
| 5,119,132 | 6/1992 | Butler | 399/49 |
| 5,155,530 | 10/1992 | Larson et al. | 399/55 |
| 5,243,383 | 9/1993 | Parice | 399/50 |
| 5,436,705 | 7/1995 | Raj | 399/59 |
| 5,450,165 | 9/1995 | Henderson | 399/49 |
| 5,576,811 | 11/1996 | Kobayashi et al. | 399/15 X |

*Primary Examiner*—Arthur T. Grimley
*Assistant Examiner*—Sophia S. Chen
*Attorney, Agent, or Firm*—Ronald F. Chapuran

[57] ABSTRACT

In process control loops by keeping the DMA (Developed Mass per unit Area) under control, the print quality can be satisfactorily maintained to within tolerance in spite of temporal variabilities in subsystem parameters. The DMA is measured by creating patches in the interdocument zones. Three patches are created, one at high area coverage (90% to 100%), one at low area coverage (0 to 20%) and one at mid tone (around 50%). These DMA readings are compared to the setpoints. The errors are processed in the controller to generate the internal process parameters known as the cleaning voltage, discharge ratio and development voltage. These internal parameters have well known meaning to the physical xerographic process. The cleaning voltage is used to indicate the background in printing. The discharge ratio gives an indication of how much dot growth is present in the halftones. Finally, the development voltage is proportional to how much toner is laid on the photoreceptor. A controller is shown with these three process parameters, so that when used appropriately, good quality color prints can be obtained.

20 Claims, 4 Drawing Sheets

DEVELOPED MASS PER UNIT AREA (DMA) CONTROLLER TO CORRECT FOR DEVELOPMENT ERRORS

This invention relates generally to an electrostatographic printing machine and, more particularly, concerns the control of developed mass per unit area (DMA) in real time using internal process parameters as actuators.

The basic reprographic process used in an electrostatographic printing machine generally involves an initial step of charging a photoconductive member to a substantially uniform potential. The charged surface of the photoconductive member is thereafter exposed to a light image of an original document to selectively dissipate the charge thereon in selected areas irradiated by the light image. This procedure records an electrostatic latent image on the photoconductive member corresponding to the informational areas contained within the original document being reproduced. The latent image is then developed by bringing a developer material including toner particles adhering triboelectrically to carrier granules into contact with the latent image. The toner particles are attracted away from the carrier granules to the latent image, forming a toner image on the photoconductive member which is subsequently transferred to a copy sheet. The copy sheet having the toner image thereon is then advanced to a fusing station for permanently affixing the toner image to the copy sheet in image configuration.

In electrostatographic machines using a drum-type or an endless belt-type photoconductive member, the photosensitive surface thereof can contain more than one image at one time as it moves through various processing stations. The portions of the photosensitive surface containing the projected images, so-called "image areas", are usually separated by a segment of the photosensitive surface called the inter-document space. After charging the photosensitive surface to a suitable charge level, the inter-document space segment of the photosensitive surface is generally discharged by a suitable lamp to avoid attracting toner particles at the development stations. Various areas on the photosensitive surface, therefore, will be charged to different voltage levels. For example, there will be the high voltage level of the initial charge on the photosensitive surface, a selectively discharged image area of the photosensitive surface, and a fully discharged portion of the photosensitive surface between the image areas.

The approach utilized for multicolor electrostatographic printing is substantially identical to the process described above. However, rather than forming a single latent image on the photoconductive surface in order to reproduce an original document, as in the case of black and white printing, multiple latent images corresponding to color separations are sequentially recorded on the photoconductive surface. Each single color electrostatic latent image is developed with toner of a color complimentary thereto and the process is repeated for differently colored images with the respective toner of complimentary color. Thereafter, each single color toner image can be transferred to the copy sheet in superimposed registration with the prior toner image, creating a multi-layered toner image on the copy sheet. Finally, this multi-layered toner image is permanently affixed to the copy sheet in substantially conventional manner to form a finished color copy.

As described, the surface of the photoconductive member must be charged by a suitable device prior to exposing the photoconductive member to a light image. This operation is typically performed by a corona charging device. One type of corona charging device comprises a current carrying electrode enclosed by a shield on three sides and a wire grid or control screen positioned thereover, and spaced apart from the open side of the shield. Biasing potentials are applied to both the electrode and the wire grid to create electrostatic fields between the charged electrode and the shield, between the charged electrode and the wire grid, and between the charged electrode and the (grounded) photoconductive member. These fields repel electrons from the electrode and the shield resulting in an electrical charge at the surface of the photoconductive member roughly equivalent to the grid voltage. The wire grid is located between the electrode and the photoconductive member for controlling the charge strength and charge uniformity on the photoconductive member as caused by the aforementioned fields.

Control of the field strength and the uniformity of the charge on the photoconductive member is very important because consistently high quality reproductions are best produced when a uniform charge having a predetermined magnitude is obtained on the photoconductive member. If the photoconductive member is not charged to a sufficient level, the electrostatic latent image obtained upon exposure will be relatively weak and the resulting deposition of development material will be correspondingly decreased. As a result, the copy produced by an undercharged photoconductor will be faded. If, however, the photoconductive member is overcharged, too much developer material will be deposited on the photoconductive member. The copy produced by an overcharged photoconductor will have a gray or dark background instead of the white background of the copy paper. In addition, areas intended to be gray will be black and tone reproduction will be poor. Moreover, if the photoconductive member is excessively overcharged, the photoconductive member can become permanently damaged.

A useful tool for measuring voltage levels on the photosensitive surface is an electrostatic voltmeter (ESV) or electrometer. The electrometer is generally rigidly secured to the reproduction machine adjacent the moving photosensitive surface and measures the voltage level of the photosensitive surface as it traverses an ESV probe. The surface voltage is a measure of the density of the charge on the photoreceptor, which is related to the quality of the print output. In order to achieve high quality printing, the surface potential on the photoreceptor at the developing zone should be within a precise range.

Various systems have been designed and implemented for controlling charging processes within a printing machine. For example, U.S. Pat. No. 5,243,383 discloses a charge control system that measures first and second surface voltage potentials to determine a dark decay rate model representative of voltage decay with respect to time. The dark decay rate model is used to determine the voltage at any point on the imaging surface corresponding to a given charge voltage. This information provides a predictive model to determine the charge voltage required to produce a target surface voltage potential at a selected point on the imaging surface.

In addition, in copying or printing systems, such as a xerographic copier, laser printer, or ink-jet printer, a common technique for monitoring the quality of prints is to artificially create a "test patch" of a predetermined desired density. The actual density of the printing material (toner or ink) in the test patch can then be optically measured by a suitable sensor to determine the effectiveness of the printing process in placing this printing material on the print sheet.

In the case of xerographic devices, such as a laser printer, the surface that is typically of most interest in determining the density of printing material thereon is the charge-retentive surface or photoreceptor, on which the electrostatic latent image is formed and subsequently, developed by causing toner particles to adhere to areas thereof that are charged in a particular way. In such a case, the optical device for determining the density of toner on the test patch, which is often referred to as a "densitometer", is disposed along the path of the photoreceptor, directly downstream of the development of the development unit. There is typically a routine within the operating system of the printer to periodically create test patches of a desired density at predetermined locations on the photoreceptor by deliberately causing the exposure system thereof to charge or discharge as necessary the surface at the location to a predetermined extent.

The test patch is then moved past the developer unit and the toner particles within the developer unit are caused to adhere to the test patch electrostatically. The more dense the toner on the test patch, the darker the test patch will appear in optical testing. The developed test patch is moved past a densitometer disposed along the path of the photoreceptor, and the light absorption of the test patch is tested; the more light that is absorbed by the test patch, the more dense the toner on the test patch. The sensor readings are then used to measure and control the tone reproduction curve (TRC) and make suitable adjustments to the system such as changing developer bias to maintain consistent quality.

Typically each patch is about an inch square that is printed as a uniform solid half tone or background area. This practice enables the sensor to read one value on the tone reproduction curve for each test patch. Thus, the traditional method of process controls involves scheduling solid area, uniform halftones or background in a test patch. For example, U.S. Pat. No. 5,060,013 discloses a control system using test patches at different locations within the image frame on the photoreceptor. A plurality of sensors are arranged to sample the test areas in defined columns of the frame and measurements coordinated with the location of the test area.

It is also known in the prior art, for example, U.S. Pat. No. 4,341,461 to provide two test targets, each having two test patches, selectably exposed to provide test data in the photoreceptor image area for control of the toner dispensing and bias control loops. In this system, the test patches are imaged in inter-document zones on the photoreceptor. In addition, U.S. Pat. No. 5,450,165 discloses the use of incoming data or customer image data as a test patch. In particular, incoming data is polled for preselected density conditions to be used for test patches to monitor print quality.

It is also known, pending application Ser. No. 08/527,616 filed Sep. 13, 1995 now U.S. Pat. No. 5,543,896, to provide a single test pattern, having a scale of pixel values, in the interdocument zone of the imaging surface and to be able to respond to the sensing of the test pattern and a reference tone reproduction curve to adjust the machine operation for print quality.

A difficulty with the prior art is the relative inability to automatically adjust and fine tune the xerographic system in response to significant changes in parameters or set points due to system drift or operator selected quality levels. It would be desirable, therefore, to provide a system to be able to more directly adjust a xerographic system requiring multiple changes in multiple control loops.

It is an object of the present invention, therefore, to be able to actuate subsystem parameters using the known relations of the physical xerography process. It is another object of the present invention to control DMA on real time by using internal process parameters as actuators. It is another object of the present invention to deliberately use internal process parameters such as discharge ratio, cleaning voltage, and development voltage as actuators in turn generating appropriate control loop targets. Other advantages of the present invention will become apparent as the following description proceeds, and the features characterizing the invention will be pointed out with particularity in the claims annexed to and forming a part of this specification.

SUMMARY OF THE INVENTION

In process control loops, by keeping the DMA (Developed Mass per unit Area) under control, the print quality can be satisfactorily maintained to within tolerance in spite of temporal variabilities in subsystem parameters. The DMA is measured by creating patches in the interdocument zones. Three patches are created, one at high area coverage (90% to 100%), one at low area coverage (0 to 20%) and one at mid tone (around 50%). These DMA readings are compared to the setpoints. The errors are processed in the controller to generate the internal process parameters known as the cleaning voltage, discharge ratio and development voltage. These internal parameters have well known meaning to the physical xerographic process. The cleaning voltage is used to indicate the background in printing. The discharge ratio gives an indication of how much dot growth is present in the halftones. Finally, the development voltage is proportional to how much toner is laid on the photoreceptor. A controller is shown with these three process parameters, so that when used appropriately, good quality color prints can be obtained. Other features of the present invention will become apparent as the following description proceeds and upon reference to the drawings, in which:

Figure 1:
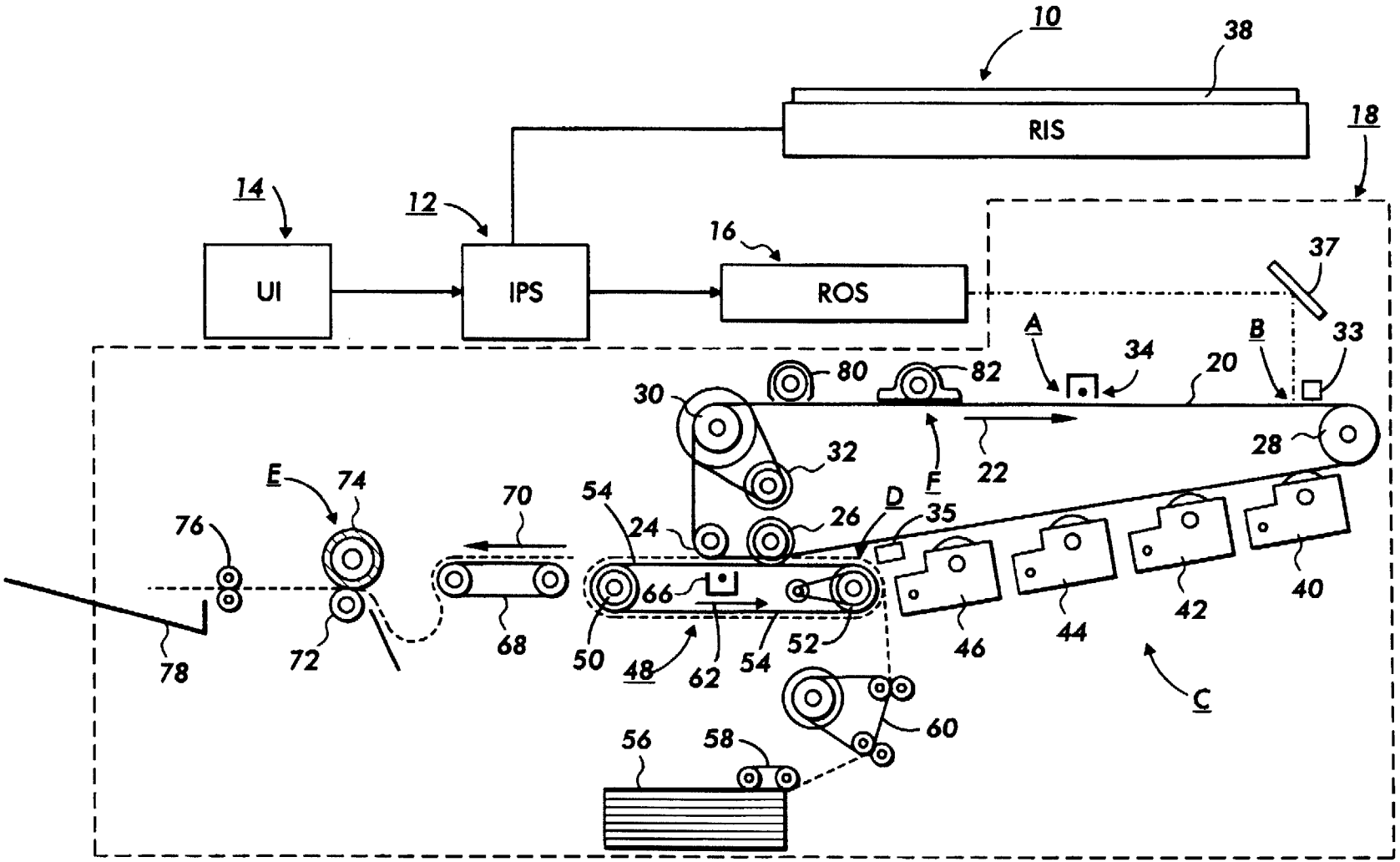
FIG. 1 is a schematic elevational view of an exemplary multi-color electrophotographic printing machine which can be utilized in the practice of the present invention.

A schematic elevational view showing an exemplary electrophotographic printing machine incorporating the features of the present invention therein is shown in FIG. 1. It will become evident from the following discussion that the present invention is equally well-suited for use in a wide variety of printing systems including ionographic printing machines and discharge area development systems, as well as other more general non-printing systems providing multiple or variable outputs such that the invention is not necessarily limited in its application to the particular system shown herein.

To initiate the copying process, a multicolor original document 38 is positioned on a raster input scanner (RIS), indicated generally by the reference numeral 10. The RIS 10 contains document illumination lamps, optics, a mechanical scanning drive, and a charge coupled device (CCD array) for capturing the entire image from original document 38. The RIS 10 converts the image to a series of raster scan lines and measures a set of primary color densities, i.e. red, green and blue densities, at each point of the original document. This information is transmitted as an electrical signal to an image processing system (IPS), indicated generally by the reference numeral 12, which converts the set of red, green and blue density signals to a set of calorimetric coordinates. The IPS contains control electronics for preparing and managing the image data flow to a raster output scanner (ROS), indicated generally by the reference numeral 16.

A user interface (UI), indicated generally by the reference numeral 14, is provided for communicating with IPS 12. UI 14 enables an operator to control the various operator adjustable functions whereby the operator actuates the appropriate input keys of UI 14 to adjust the parameters of the copy. UI 14 may be a touch screen, or any other suitable device for providing an operator interface with the system. The output signal from UI 14 is transmitted to IPS 12 which then transmits signals corresponding to the desired image to ROS 16.

ROS 16 includes a laser with rotating polygon mirror blocks. The ROS 16 illuminates, via mirror 37, a charged portion of a photoconductive belt 20 of a printer or marking engine, indicated generally by the reference numeral 18. Preferably, a multi-facet polygon mirror is used to illuminate the photoreceptor belt 20 at a rate of about 400 pixels per inch. The ROS 16 exposes the photoconductive belt 20 to record a set of three subtractive primary latent images thereon corresponding to the signals transmitted from IPS 12. One latent image is to be developed with cyan developer material, another latent image is to be developed with magenta developer material, and the third latent image is to be developed with yellow developer material. These developed images are subsequently transferred to a copy sheet in superimposed registration with one another to form a multicolored image on the copy sheet which is then fused thereto to form a color copy. This process will be discussed in greater detail hereinbelow.

With continued reference to FIG. 1, marking engine 18 is an electrophotographic printing machine comprising photoconductive belt 20 which is entrained about transfer rollers 24 and 26, tensioning roller 28, and drive roller 30. Drive roller 30 is rotated by a motor or other suitable mechanism coupled to the drive roller 30 by suitable means such as a belt drive 32. As roller 30 rotates, it advances photoconductive belt 20 in the direction of arrow 22 to sequentially advance successive portions of the photoconductive belt 20 through the various processing stations disposed about the path of movement thereof.

Photoconductive belt 20 is preferably made from a polychromatic photoconductive material comprising an anti-curl layer, a supporting substrate layer and an electrophotographic imaging single layer or multi-layers. The imaging layer may contain homogeneous, heterogeneous, inorganic or organic compositions. Preferably, finely divided particles of a photoconductive inorganic compound are dispersed in an electrically insulating organic resin binder. Typical photoconductive particles include metal free phthalocyanine, such as copper phthalocyanine, quinacridones, 2,4-diaminotriazines and polynuclear aromatic quinines. Typical organic resinous binders include polycarbonates, acrylate polymers, vinyl polymers, cellulose polymers, polyesters, polysiloxanes, polyamides, polyurethanes, epoxies, and the like.

Initially, a portion of photoconductive belt 20 passes through a charging station, indicated generally by the reference letter A. At charging station A, a corona generating device 34 or other charging device generates a charge voltage to charge photoconductive belt 20 to a relatively high, substantially uniform voltage potential. The corona generator 34 comprises a corona generating electrode, a shield partially enclosing the electrode, and a grid disposed between the belt 20 and the unenclosed portion of the electrode. The electrode charges the photoconductive surface of the belt 20 via corona discharge. The voltage potential applied to the photoconductive surface of the belt 20 is varied by controlling the voltage potential of the wire grid.

Next, the charged photoconductive surface is rotated to an exposure station, indicated generally by the reference letter B. Exposure station B receives a modulated light beam corresponding to information derived by RIS 10 having a multicolored original document 38 positioned there at. The modulated light beam impinges on the surface of photoconductive belt 20, selectively illuminating the charged surface of photoconductive belt 20 to form an electrostatic latent image thereon. The photoconductive belt 20 is exposed three times to record three latent images representing each color.

After the electrostatic latent images have been recorded on photoconductive belt 20, the belt is advanced toward a development station, indicated generally by the reference letter C. However, before reaching the development station C, the photoconductive belt 20 passes subjacent to a voltage monitor, preferably an electrostatic voltmeter 33, for measurement of the voltage potential at the surface of the photoconductive belt 20. The electrostatic voltmeter 33 can be any suitable type known in the art wherein the charge on the photoconductive surface of the belt 20 is sensed, such as disclosed in U.S. Pat. Nos. 3,870,968; 4,205,257; or 4,853,639, the contents of which are incorporated by reference herein.

A typical electrostatic voltmeter is controlled by a switching arrangement which provides the measuring condition in which charge is induced on a probe electrode corresponding to the sensed voltage level of the belt 20. The induced charge is proportional to the sum of the internal capacitance of the probe and its associated circuitry, relative to the probe-to-measured surface capacitance. A DC measurement circuit is combined with the electrostatic voltmeter circuit for providing an output which can be read by a conventional test meter or input to a control circuit, as for example, the control circuit of the present invention. The voltage potential measurement of the photoconductive belt 20 is utilized to determine specific parameters for maintaining a predetermined potential on the photoreceptor surface, as will be understood with reference to the specific subject matter of the present invention, explained in detail hereinbelow.

The development station C includes four individual developer units indicated by reference numerals 40, 42, 44 and 46 and an optical sensor 35. The developer units are of a type generally referred to in the art as "magnetic brush development units". Typically, a magnetic brush development system employs a magnetizable developer material including magnetic carrier granules having toner particles adhering triboelectrically thereto. The developer material is continually brought through a directional flux field to form a brush of developer material. The developer material is constantly moving so as to continually provide the brush with fresh developer material. Development is achieved by bringing the brush of developer material into contact with the photoconductive surface.

Developer units 40, 42, and 44, respectively, apply toner particles of a specific color corresponding to the compliment of the specific color separated electrostatic latent image recorded on the photoconductive surface. Each of the toner particle colors is adapted to absorb light within a preselected spectral region of the electromagnetic wave spectrum. For example, an electrostatic latent image formed by discharging the portions of charge on the photoconductive belt corresponding to the green regions of the original document will record the red and blue portions as areas of relatively high charge density on photoconductive belt 20, while the green areas will be reduced to a voltage level ineffective for development. The charged areas are then made visible by having developer unit 40 apply green absorbing (magenta) toner particles onto the electrostatic latent image recorded on photoconductive belt 20. Similarly, a blue separation is developed by developer unit 42 with blue absorbing (yellow) toner particles, while the red separation is developed by developer unit 44 with red absorbing (cyan) toner particles. Developer unit 46 contains black toner particles and may be used to develop the electrostatic latent image formed from a black and white original document.

In FIG. 1, developer unit 40 is shown in the operative position with developer units 42, 44 and 46 being in the non-operative position. During development of each electrostatic latent image, only one developer unit is in the operative position, while the remaining developer units are in the non-operative position. Each of the developer units is moved into and out of an operative position. In the operative position, the magnetic brush is positioned substantially adjacent the photoconductive belt, while in the non-operative position, the magnetic brush is spaced therefrom. Thus, each electrostatic latent image or panel is developed with toner particles of the appropriate color without commingling.

After development, the toner image is moved passed a suitable densitometer or toner area coverage sensor 35 such as disclosed in U.S. Pat. No. 5,060,013 discussed above to a transfer station, indicated generally by the reference letter D. Transfer station D includes a transfer zone, defining the position at which the toner image is transferred to a sheet of support material, which may be a sheet of plain paper or any other suitable support substrate. A sheet transport apparatus, indicated generally by the reference numeral 48, moves the sheet into contact with photoconductive belt 20. Sheet transport 48 has a belt 54 entrained about a pair of substantially cylindrical rollers 50 and 52. A friction retard feeder 58 advances the uppermost sheet from stack 56 onto a pre-transfer transport 60 for advancing a sheet to sheet transport 48 in synchronism with the movement thereof so that the leading edge of the sheet arrives at a preselected position, i.e. a loading zone. The sheet is received by the sheet transport 48 for movement therewith in a recirculating path. As belt 54 of transport 48 moves in the direction of arrow 62, the sheet is moved into contact with the photoconductive belt 20, in synchronism with the toner image developed thereon.

In transfer zone 64, a corona generating device 66 sprays ions onto the backside of the sheet so as to charge the sheet to the proper magnitude and polarity for attracting the toner image from photoconductive belt 20 thereto. The sheet remains secured to the sheet gripper so as to move in a recirculating path for three cycles. In this manner, three different color toner images are transferred to the sheet in superimposed registration with one another. Each of the electrostatic latent images recorded on the photoconductive surface is developed with the appropriately colored toner and transferred, in superimposed registration with one another, to the sheet for forming the multi-color copy of the colored original document. One skilled in the art will appreciate that the sheet may move in a recirculating path for four cycles when undercolor black removal is used.

After the last transfer operation, the sheet transport system directs the sheet to a vacuum conveyor, indicated generally by the reference numeral 68. Vacuum conveyor 68 transports the sheet, in the direction of arrow 70, to a fusing station, indicated generally by the reference letter E, where the transferred toner image is permanently fused to the sheet. The fusing station includes a heated fuser roll 74 and a pressure roll 72. The sheet passes through the nip defined by fuser roll 74 and pressure roll 72. The toner image contacts fuser roll 74 so as to be affixed to the sheet. Thereafter, the sheet is advanced by a pair of rolls 76 to a catch tray 78 for subsequent removal therefrom by the machine operator.

The last processing station in the direction of movement of belt 20, as indicated by arrow 22, is a cleaning station, indicated generally by the reference letter F. A lamp 80 illuminates the surface of photoconductive belt 20 to remove any residual charge remaining thereon. Thereafter, a rotatably mounted fibrous brush 82 is positioned in the cleaning station and maintained in contact with photoconductive belt 20 to remove residual toner particles remaining from the transfer operation prior to the start of the next successive imaging cycle.

Figure 2:
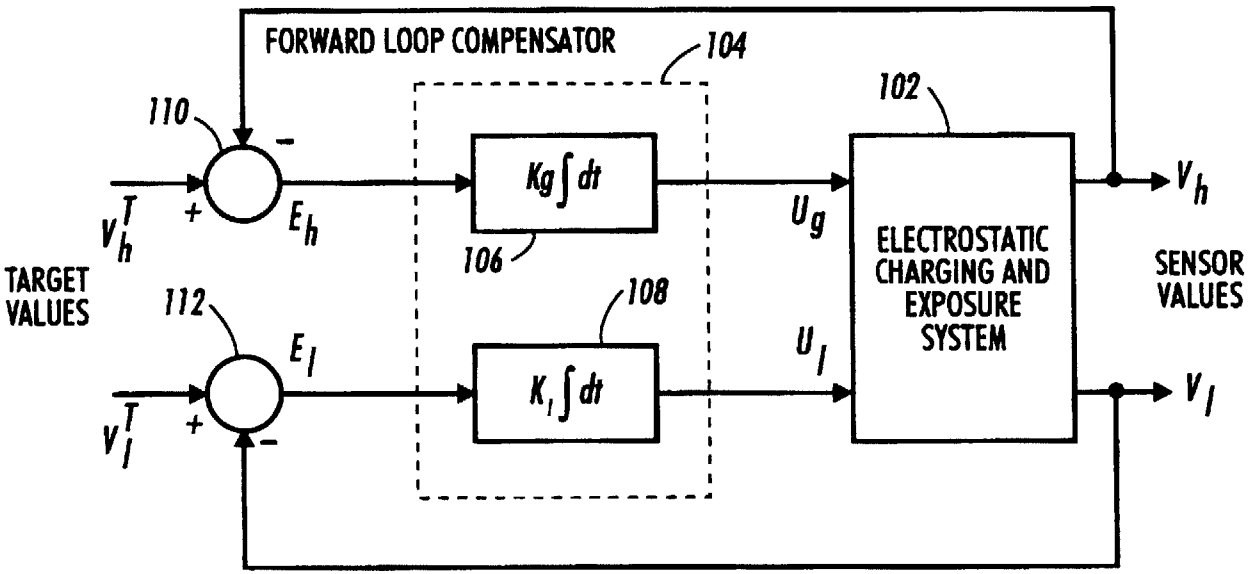
FIG. 2 (Prior Art)
FIG. 2 is a diagram of a typical prior art electrostatic feedback control system.

A diagrammatic representation of the system currently under practice for most xerographic print engines is shown in FIG. 2. Block 102 represents the charging and exposure systems. The block 104 representing compensators usually contains suitable integrators such as 106, 108 with some weighting. Here $V_h$ represents the voltage on the unexposed photoreceptor and $V_l$ represents the voltage after the exposure. $V_h^T$ and $V_l^T$ are the desired states for the voltages $V_h$ and $V_l$, and $E_h$ is the error generated by subtracting the $V_h^T$ values with those measured by the ESV. Similarly, $E_l$ is the error generated by subtracting the $V_l^T$ values with those measured by the ESV. $U_g$ and $U_l$ are the control signals to vary the grid voltage and laser power respectively.

In accordance with the present invention, there is shown a hierarchical loop architecture. In a first loop, electrostatic parameters are controlled in approximately one to five print intervals by processing the error between setpoints and the photoreceptor voltages (both exposed and unexposed portions of the photoreceptor). The grid voltage on the charging system and the average beam power on the exposure system are the two actuators that are used for controlling the electrostatic parameters. This kind of loop is called a Level 1 loop or level 1 controller shown as 120 in FIG. 3 providing suitable control signals to the electrostatic charging and exposure systems shown at 122. The electrostatic charging and exposure systems are tracked by an ESV sensor providing sensed signals illustrated at 124. The sensor signals or values 124 are compared with suitable references or target values 128 in comparators **126*a* and 126*b* to provide error signals 129 to Level 1 controller 120**. The gains in level 1 loops are tuned such that the photoreceptor voltages will converge to setpoints in some finite prints.

In accordance with the present invention, the setpoints or target values 128 for the electrostatic control system are generated from Level 2 loops or level 2 controllers shown at 130. In level 2 loops, DMA measurements or sensor values illustrated at 134 from optical sensors are compared in comparators **136*a*, 136*b*, 136*c* to target DMAs shown at 138 and the error signals shown at 139 are processed through level 2 controller 130 to generate setpoints or target values 128 for Level 1 loops. Level 2 controller 130 also generates control signals for the development system 132**. The Level 2 loop gains are tuned such that the loop is enabled to work at every 10 to 30 prints. It has been shown that if Level 2 loops are not present then the prints will have unacceptable color shifts giving rise to large changes between prints.

Figure 3:
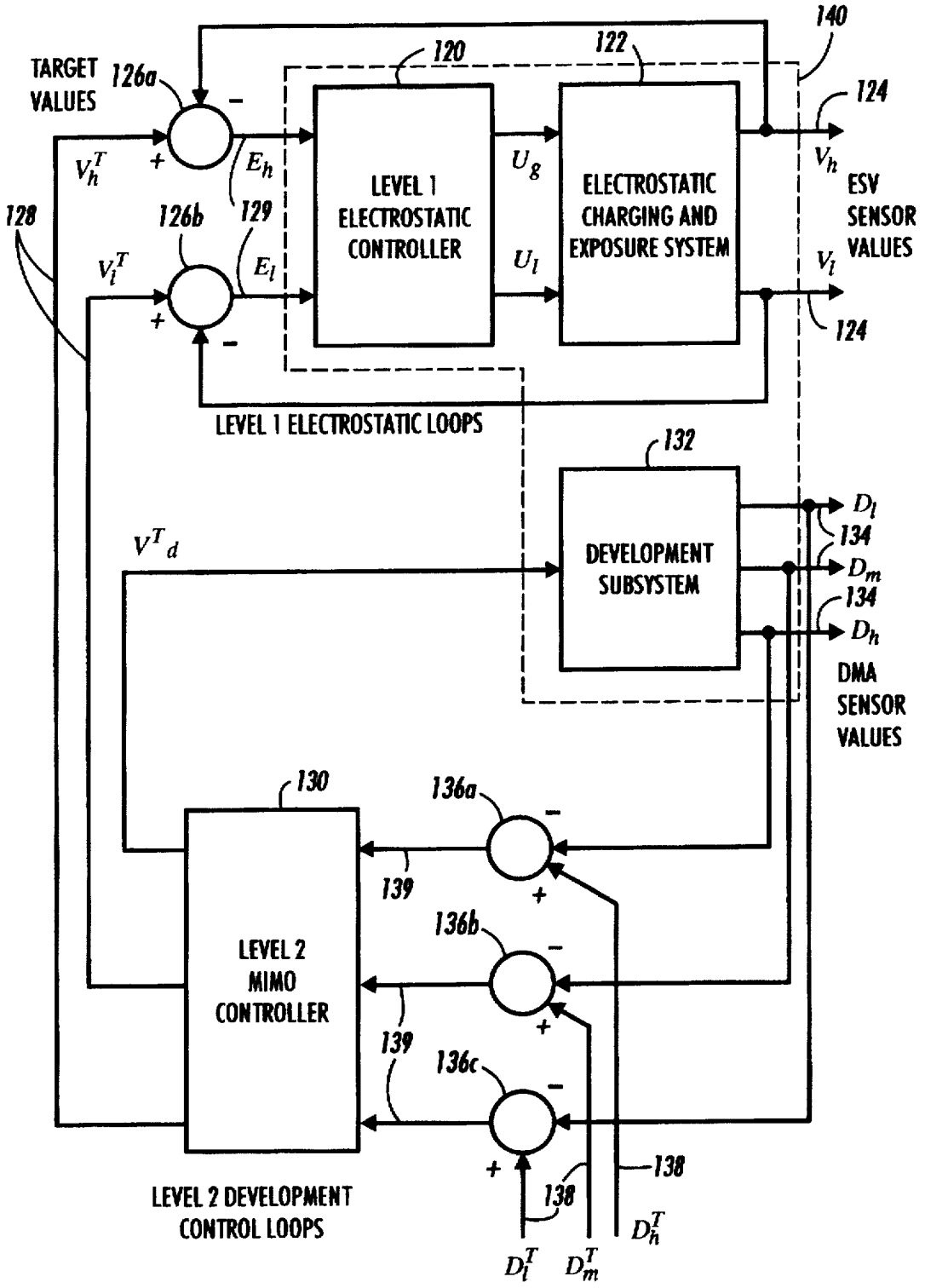
FIG. 3 is a block diagram illustrating electrostatic and development control loops in accordance with the present invention.
Figure 4:
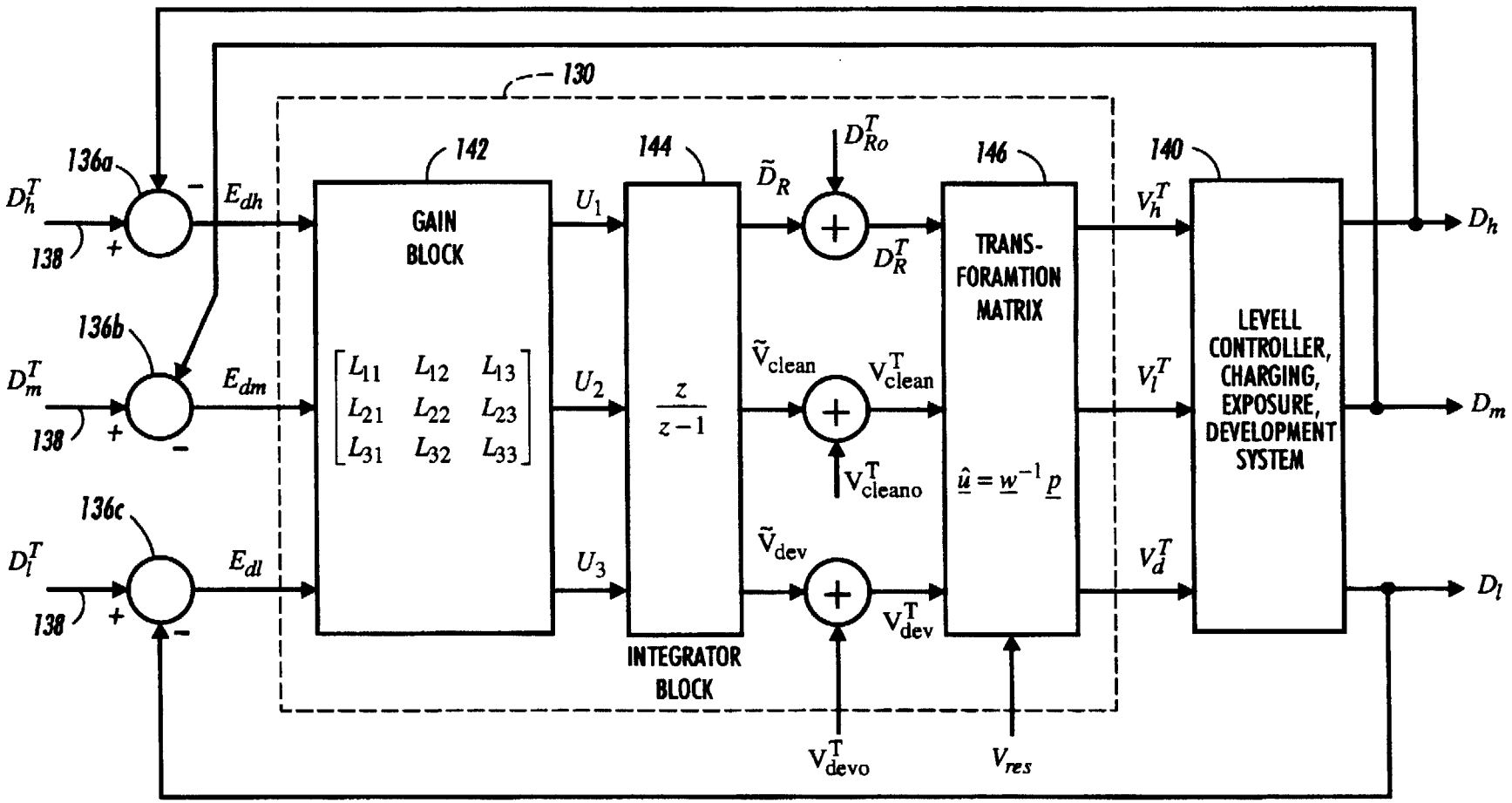
FIG. 4 is a block diagram illustrating the development control loop of FIG. 3 in more detail in accordance with the present invention.

FIG. 4 is a more detailed block diagram of level 2 controller 130 connected to level 1 controller and the charging, exposure, and development systems illustrated at 140. In FIG. 3, dotted block 140 encompasses level 1 controller 120, charging and exposure system 122, and development system 132. Level 2 controller 130 includes gain matrix block 142 including matrix elements $L_{11}$, $L_{12}$, $L_{13}$, $L_{21}$, $L_{22}$, $L_{23}$, $L_{31}$, $L_{32}$, $L_{33}$, integrator block 144, and transformation matrix 146. Level 2 controller 130 uses three internal process parameters, in particular, a discharge ratio (affecting the dot growth largely in the mid-toned regions as compared to solid areas), cleaning voltage (affecting background and dot growth of the image on the photoreceptor) and development voltage (affecting the development of toner on the image throughout the byte space) as three actuators.

These three actuators in turn generate appropriate Level 1 targets as well as a donor voltage for subsequent actuation of the subsystem parameters using the known relations of the physical xerography process. The internal process parameters give a better understanding of the process as prints are made. This results in the control of DMA on real time by using the internal process parameters as actuators. This control procedure is described below by first discussing the relationship between these new actuators and the system parameters that effect developability.

Let $V_h^T$ and $V_l^T$ be the voltages used as setpoints for Level 1 loop. When Level 1 loop is converged, unexposed and exposed portions of the photoreceptor will have reached the setpoints and will remain there with zero steady state error for subsequent prints. Also, let $V_{res}$ is the residual voltage on the fully exposed photoreceptor. Under this steady state scenario the discharge ratio is given by:

$$D_R^T = \frac{V_l^T - V_{res}}{V_h^T - V_{res}} \tag{1}$$

The background of the image is affected by the cleaning voltage ($V_{clean}^T$). Whereas the development is affected by the development voltage ($V_{dev}^T$). They are related to electrostatic and development parameters (for a discharge area development system) by following equations.

$$V_{clean}^T = V_h^T - V_d^T \text{ and } V_{dev}^T = V_d^T - V_l^T \tag{2}$$

In equation 2, the development system parameter, $V_d^T$, represents the donor bias voltage. Using equations (1) and (2) we obtain the following transformation matrix.

$$\begin{bmatrix} 1 & 0 & -1 \\ 0 & -1 & 1 \\ D_R^T & -1 & 0 \end{bmatrix} \begin{bmatrix} V_h^T \\ V_l^T \\ V_d^T \end{bmatrix} = \begin{bmatrix} V_{clean}^T \\ V_{dev}^T \\ (D_R^T - 1)V_{res} \end{bmatrix} \tag{3}$$

$$\underline{w}(k)\hat{\underline{u}}(k) = \underline{p}(k) \tag{4}$$

Equation 4 is the representation of equation 3 in short form. It is used to generate the Level 1 targets and the donor voltage for the development subsystem once we know the internal process parameters, discharge ratio, cleaning voltage and the development voltage. In the feedback loop these intermediate actuators are obtained by measuring the errors between the developed toner mass and the targets at three different points on the TRC (tone reproduction curve) space.

The block diagram of the control algorithm is illustrated in FIG. 4. The algorithms used in this new approach contain several blocks of sequential processing elements. The error signals, $E_{dh}$, $E_{dm}$ and $E_{dl}$, are weighted by the gain matrix block 142. The output of this block signals U, $U_2$ and $U_3$ are processed using a forward rectangular integrator block 144 (this is used to make the steady state error zero between the actual DMA and their setpoints). The output of the integrators is summed with the nominal actuator values to obtain the internal process parameters, $V_{clean}^T$, $D_R^T$ and $V_{dev}^T$. The block with transformation matrix is used to compute the setpoints for Level 1 ($V_h^T$ and $V_l^T$) and the donor voltage, $V_d^T$. Since this approach is used in conjunction with the hierarchical Level 1 and Level 2 architecture of FIG. 3, DMA corrections are enabled after Level 1 loops have settled down completely. Toner concentration is held constant by another set of (not shown) loops.

To compute the values of the gain matrix at the nominal operating point, sensitivity studies of the system are done as follows. At first the sensitivity matrix is obtained. The sensitivity matrix is given by the slopes of the curves, $D_R^T$ v/s ($D_h$, $D_m$, $D_l$), $V_{clean}^T$ v/s ($D_h$,$D_m$,$D_l$) and $V_{dev}^T$ v/s ($D_h$,$D_m$,$D_l$) around the nominal operating points, $D_{Ro}^T$, $V_{cleano}^T$ and $V_{devo}^T$. Key steps in determining the sensitivity matrix are shown below.

1. Have the loops opened.
2. Set $D_{Ro}^T$, $V_{cleano}^T$ and $V_{devo}^T$ to the nominal operating points.
3. Set $\tilde{V}_{clean}=0$ and $\tilde{V}_{dev}=0$ (notations are shown in FIG. 4).
4. Vary $\tilde{D}_R$ to some values around the nominal values of $D_{Ro}^T$. Measure $D_h$, $D_m$, $D_l$ for each values of $\tilde{D}_R$. These curves will give three elements of the sensitivity matrix.
5. Set $\tilde{D}_R=0$ and $\tilde{V}_{dev}=0$.
6. Vary $\tilde{V}_{clean}$ to some values around the nominal values of $V_{cleano}^T$. Measure $D_h$, $D_m$, $D_l$ for each values of $\tilde{V}_{clean}$. These curves will give another set of three elements of the sensitivity matrix.
7. Set $\tilde{D}_R=0$ and $\tilde{V}_{clean}=0$
8. Now vary $\tilde{V}_{dev}$ to some values around the nominal values of $V_{devo}^T$. Measure $D_h$, $D_m$, $D_l$ for each values of $\tilde{V}_{dev}$. These curves will give the remaining three elements of the sensitivity matrix.

Once the sensitivity matrix is measured around the nominal operating points, the gain matrix is calculated by taking the inverse of the sensitivity matrix For a dead beat control, it has been shown that (in a discrete system of the type described in FIGS. 3 and 4) the eigenvalues of the entire closed loop control system must be made equal to zero. In a discrete dynamical system, when there is dead beat control, change in output occurs for a step change in targets in a minimum number of steps. For a three-input three-output system, such as the type described by FIG. 4, dead beat control can be obtained in the next sample if the gain matrix is made equal to the inverse of the sensitivity matrix. Dead beat control is extremely useful for printers because of the fact that when DMA targets change (when different types of papers are used DMA targets is likely to change), the control system should provide the right DMA in the next immediate print without overshoot and then hold the targets to the desired values with zero steady state error.

This type of process controller is under consideration for upcoming products. In addition to the simplicity, in this type of process controller, the background, development voltage and the dot growth can be adjusted by simply varying the nominal values. If there are two or more sets of nominal values, then the corresponding sets of feedback gains are generated for those nominal values. Depending on location in the operating space, gains can be interpolated to achieve adequate performance at intermediate points where the plant is expected to operate. In this way, a nonlinear xerographic system can be controlled using the architecture proposed. Clearly since the internal xerographic parameters have been extracted, it would enable the setting of each one appropriately, depending on the need, like background correction, or dot growth compensation or overall toner development mass compensation. A direct knob can be provided to vary the nominal values of these internal process parameters from the higher level controls. This approach will also help for online real time diagnostics.

While this invention has been described in conjunction with a specific embodiment thereof, it is evident that many alternatives, modifications, and variations will be apparent to those skilled in the art. Accordingly, it is intended to embrace all such alternatives, modifications and variations that fall within the spirit and broad scope of the appended claims.

We claim:

1. In an imaging machine having an imaging member and electrostatic and development subsystems, a multi-level control comprising:

a first control loop responsive to imaging member voltage potential and first target values to adjust the electrostatic subsystem, a second control loop responsive to developed mass per unit area on the imaging member to adjust the development subsystem, the second control loop including a control device for providing the first target values to the first control loop, the control device including a transformation matrix responding to internal process parameters to compute the first target values for the first control loop.

2. The imaging machine of claim 1 wherein the first control loop includes an ESV sensor responsive to imaging member voltage potential.

3. The imaging machine of claim 1 wherein the second control loop includes a sensor to measure developed mass per unit area, the sensor measuring at least three test patches on the imaging member including high area coverage, low area coverage, and mid tone coverage.

4. The imaging machine of claim 1, wherein the control device includes a gain matrix block and an integrator block.

5. The imaging machine of claim 1 wherein the control device includes nominal actuator values and the output of the integrator block is summed with the nominal actuator values to provide internal process parameters related to the electrostatic and development subsystems.

6. An electrostatographic printing machine having an imaging member, charging, exposure, and development subsystems, and a control including target values and control loops comprising:

a first sensor to measure imaging member voltage potential, a first control loop responsive to imaging member voltage potential and first target values to adjust the charging and exposure subsystems, a second sensor to measure developed mass per unit area on the imaging member, and a second control loop responsive to developed mass per unit area on the imaging member and second target values to adjust the development subsystem, the second control loop including a control device for providing the first target values to the first control loop, the control device including a gain matrix block, an integrator block, and a transformation matrix, the output of the integrator block being summed with nominal actuator values to provide internal process parameters related to the charge, exposure, and development subsystems, the transformation matrix responding to the internal process parameters to compute the first target values for the first control loop.

7. The electrostatographic printing machine of claim 6 wherein the first target values for the first control loop are for a cleaning voltage actuator and a discharge ratio actuator.

8. An electrostatographic printing machine having an imaging member, charging, exposure, and development subsystems, and a control including target values and control loops comprising:

a first sensor to measure imaging member voltage potential, a first control loop responsive to imaging member voltage potential and first target values to adjust the charging and exposure subsystems, a second sensor to measure developed mass per unit area on the imaging member, a second control loop responsive to developed mass per unit area on the imaging member and second target values to adjust the development subsystem, the second control loop including a control device including a gain matrix block and an integrator block for providing the first target values to the first control loop.

9. The electrostatographic printing machine of claim 8 wherein the control device includes nominal actuator values and the output of the integrator block is summed with the nominal actuator values to provide internal process parameters related to the charge, exposure, and development subsystems.

10. The electrostatographic printing machine of claim 9 wherein the control device includes a transformation matrix responding to the internal process parameters to compute the first target values for the first control loop.

11. The electrostatographic printing machine of claim 10 wherein the first target values for the first control loop are for a cleaning voltage actuator and a discharge ratio actuator.

12. The electrostatographic printing machine of claim 8 wherein the second sensor measures low, medium, and high developed toner mass per unit area samples on the imaging member.

13. An electrostatographic printing machine having an imaging member, electrostatic and development subsystems, the electrostatic and development subsystems having target values, and a control including control loops comprising:

a first sensor to measure a first machine characteristic, a first control loop responsive to the first machine characteristic and first target values to adjust one of the electrostatic and development subsystems, a second sensor to measure a second machine characteristic, a second control loop responsive to the second machine characteristic and second target values to adjust the other of the electrostatic and development subsystems, one of the control loops including a gain matrix and integrator block for providing either the first or second target values for the other control loop.

14. The electrostatographic printing machine of claim 13, wherein the first sensor measures imaging member voltage potential and the second sensor measures developed mass per unit area on the imaging member.

15. The electrostatographic printing machine of claim 13 wherein said one of the control loops providing either the first or second target values for the other control loop includes nominal actuator values and the output of the integrator block is summed with the nominal actuator values to provide internal process parameters related to the electrostatic and development subsystems.

16. The electrostatographic printing machine of claim 15 wherein said one of the control loops providing either the first or second target values for the other control loop includes a transformation matrix responding to the internal process parameters to compute the first target values for said other control loop.

17. The electrostatographic printing machine of claim 13 wherein the second sensor measures low, medium, and high developed toner mass per unit area samples on the imaging member.

18. An electrostatographic printing machine having an imaging member, electrostatic and development subsystems, the electrostatic and development subsystems having target values, and a control including control loops comprising:

a first sensor to measure a first machine characteristic, a first control loop responsive to the first machine characteristic and first target values to adjust one of the electrostatic and development subsystems, a second sensor to measure a second machine characteristic, a second control loop responsive to the second machine characteristic and second target values to adjust the other of the electrostatic and development subsystems, one of the control loops providing either the first or second target values for the other control loop, said one of the control loops providing the target values for the other control loop including a gain matrix block and an integrator block.

19. The electrostatographic printing machine of claim 18 wherein said one of the control loops providing either the first or second target values for the other control loop includes nominal actuator values and the output of the integrator block is summed with the nominal actuator values to provide internal process parameters related to the electrostatic and development subsystems.

20. The electrostatographic printing machine of claim 19 wherein said one of the control loops providing either the first or second target values for the other control loop includes a transformation matrix responding to the internal process parameters to compute the first target values for said other control loop.

* * * * *